US006176999B1

(12) United States Patent
Jaworowski et al.

(10) Patent No.: US 6,176,999 B1
(45) Date of Patent: Jan. 23, 2001

(54) FEEDBACK CONTROLLED STRIPPING OF AIRFOILS

(75) Inventors: Mark Jaworowski, Glastonbury; Michael A. Kryzman, West Hartford, both of CT (US)

(73) Assignee: United Technologies Corporation, Hartford, CT (US)

( * ) Notice: Under 35 U.S.C. 154(b), the term of this patent shall be extended for 0 days.

(21) Appl. No.: 09/216,469

(22) Filed: Dec. 18, 1998

(51) Int. Cl.[7] ..... C25F 5/00

(52) U.S. Cl. ..... 205/717; 205/718; 205/720; 205/723

(58) Field of Search ..... 205/717, 718, 205/719, 720, 721, 723

(56) References Cited

U.S. PATENT DOCUMENTS

| | | | | |
|---|---|---|---|---|
| 3,779,879 | * | 12/1973 | Scott | 204/146 |
| 4,128,463 | | 12/1978 | Formanik | 204/146 |
| 4,261,804 | * | 4/1981 | McGivern, Jr. | 204/146 |
| 4,678,552 | | 7/1987 | Chen | 204/146 |
| 4,886,552 | * | 12/1989 | Jaworowski et al. | 134/27 |
| 4,894,130 | | 1/1990 | Sova | 204/129.35 |

FOREIGN PATENT DOCUMENTS

| | | |
|---|---|---|
| 0318886 | 6/1989 | (EP) . |
| 4346700 | 12/1992 | (JP) . |
| 9041199 | 2/1997 | (JP) . |

OTHER PUBLICATIONS

Search Report of European Patent Application dated Mar. 9, 2000.

* cited by examiner

*Primary Examiner*—Kathryn Gorgos
*Assistant Examiner*—Thomas H. Parsons
(74) *Attorney, Agent, or Firm*—Williams A. Simons; Wiggin & Dana

(57) ABSTRACT

A process for electrochemically stripping a coating from an airfoil that includes immersing the airfoil in the electrochemical acid bath for a sufficient period of time to remove the coating from the airfoil while maintaining a controlled absolute electrical potential with respect to a reference electrode or a controlled electrical current density on the airfoil surface.

11 Claims, No Drawings

FEEDBACK CONTROLLED STRIPPING OF AIRFOILS

BACKGROUND OF THE INVENTION

1. Field of the Invention

The present invention relates to the process of electrochemically stripping coatings from airfoils.

2. Description of the Related Art

Gas turbine engines in aircraft are taken out of service at periodic intervals and regular maintenance service is performed on them. Part of the regular repair sequence for the blades and vanes (individually or together referred to hereafter as "airfoils") of these engines includes the removal and then replacement of the worn coatings from their surfaces. These coatings are usually either an aluminide coating or an MCrAlY coating. The underlying base metal of airfoils are generally made of either a nickel base alloy or a cobalt base alloy. These coatings provide airfoils with a thermal barrier to the hot corrosive environment in which airfoils operate.

In the past, these aluminide and MCrAlY coatings were removed from airfoils by soaking the parts either in nitric acid solutions (to remove aluminide coatings) or in hydrochloric acid solutions (to remove MCrAlY coatings) in high acid concentrations for up to six hours at elevated temperatures. Several disadvantages are associated with this soaking process.

This soaking process is extremely labor intensive and can produce non-uniform and unpredictable results. It can also damage or destroy airfoils if improperly carried out. Furthermore, each airfoil part requires extensive masking to protect areas sensitive to the acid soaking solution. Such areas include internal surfaces and the root section of the airfoil. These masking operations are costly, add significant time to the repair process and, if not properly carried out, can lead to damaged or destroyed parts. Still further, these soaking processes may result in extensive amounts of acidic waste solution that must be properly disposed of as well as have a long cycle time and require relatively large amounts of energy to heat the acidic solutions.

Accordingly, a better airfoil stripping process is needed by the engine maintenance and repair industry. This better airfoil stripping process should be one that has a reduced cycle time; requires a reduced amount of labor; requires less masking and lower operating temperatures; produces less hazardous waste effluent; requires less heating energy; and produces uniform and predictable stripping results so that fewer parts are damaged, destroyed or require recycling. The present invention provides a solution to these needs.

BRIEF SUMMARY OF THE INVENTION

Therefore, one aspect of the present invention is directed to a process for electrochemically stripping a coating from an airfoil comprising or including immersing the airfoil in an electrochemical acid bath for a sufficient period of time to remove the coating from the airfoil while maintaining a controlled absolute electrical potential with respect to a reference electrode or a controlled electrical current density on the airfoil surface.

DESCRIPTION OF THE PREFERRED EMBODIMENTS

The phrase "controlled absolute electrical potential with respect to a reference electrode" as used herein means the electrical potential as measured between the airfoil (as a working electrode) and a non-polarized reference electrode in a three-wire electrode setup in the electrochemical acid bath that is controlled to affect a suitable rate of stripping of the coating from the airfoil base metal.

A phrase "controlled electrical current density on the airfoil surface" as used herein means the electrical current is measured as the current flow between the airfoil and the counter electrode in the electrochemical acid bath while the absolute potential of the airfoil is monitored with respect to a non-polarized reference electrode also present in the electrochemical acid bath.

The phrase "three wire electrode setup" as used herein refers to the use of an airfoil as the working electrode while also having at least one counter electrode and non-polarized reference electrode in the electrochemical acid bath.

The present invention is based on the application of an external anodic current to the coated airfoils, which results in an increase in the potential of the airfoil. Thus, the rate of the acidic stripping process is increased significantly while being able to operate at either lower acid concentrations, at lower operating temperatures and/or at shorter periods of time than conventional soaking processes. This use of less aggressive solutions or lower temperatures or shorter reaction times or combinations thereof allows for use of less costly and less complex masking materials. Furthermore, upon removal of the coating material, the electrochemical current may be automatically stopped or reversed to obtain the desired stripping effect without going too far and thus destroying or damaging the airfoil.

The present invention can be carried out using either controlled absolute potential stripping or controlled current stripping. The coatings that may be removed by this process include one or more aluminide coatings or one or more MCrAlY coatings or mixtures thereof. Examples of MCrAlY coatings include NiCoCrAlY, NiCrAlY and CoCrAlY.

The controlled potential stripping preferably uses a constant absolute electrical potential on the airfoil in the acid bath. The constant potential provides activation energy for dissolution of the coating material, and also causes a difference in the intrinsic corrosion current density between the airfoil base metal and the coating material. Alternatively, it may be desired in some situations to employ a variable absolute potential with respect to a reference electrode. By controlling the absolute potential of the airfoil, the coating removal rate will vary over time (i.e. will be smaller as more is removed). This embodiment provides good selectivity for coating removal, but requires a complex potentiostatic power supply. Accordingly, controlled absolute potential stripping is preferred where selectivity is the primary concern.

The controlled current stripping operation is preferably a constant current stripping; although variable current stripping may also be used in some instances. This embodiment may be conducted without the need for complex equipment (e.g. a simple rectifier may be used). A constant applied current between the airfoil parts and the counter electrode in the acid bath will remove the coating at a constant rate. Since this embodiment does not discriminate between removing the coating material or the underlying airfoil base metal, excessive stripping may produce unwanted base metal pitting or removal. Thus, more carefully monitoring is required for this embodiment than the constant potential stripping embodiment. On the other hand, the equipment required is simpler to operate and less expensive than the other embodiment.

In either case, it is desirable to select the optimum electrical potential or current for conducting this electrochemical reaction. This optimum level may be found by measuring the current density of coated and stripped airfoils to find the optimum point where the selectivity of stripping the coated material from the airfoil metal is greatest.

Preferably, the electrochemical bath may be of any standard acid resistant material to which an external anionic current may be applied to the airfoil parts partly immersed in the acidic bath. The working electrodes for the baths will be the airfoils themselves. One or more counter electrodes (preferably, standard graphite electrodes) will be placed in the bath. And a reference electrode (preferably an Ag/AgCl reference electrode) is placed in the bath. Specifically, the airfoil parts are first suitably masked (which may be less than the masking required for the conventional soaking process) to cover any acid sensitive surfaces. The airfoil parts are preferably affixed to an insulating fixture at the root section of the airfoil so that the blade reactions of the airfoil are immersed into the bath up to the platform section of the airfoil. The root sections are not immersed in the bath and unlike the conventional soaking stripping process, do not require masking. The insulating fixture holding one or more of these airfoils is preferably made of titanium or any other suitable noble metal. Alternatively, the airfoil may be completely immersed after masking the root section and other acid sensitive surfaces.

In operation, one or more of the root sections of the coated airfoils are preferably clamped into the titanium fixture or other type of insulating fixture. The airfoil is then immersed up to the platform section so that the blade or vane section is completely in the acidic solution. The electrical current is applied with either the electrical potential or the current amplitude being controlled. The reference electrode is used to measure or monitor the electrical potential of the airfoil in the bath. In the case of controlled electrical potential stripping, the reference electrode is connected to potentiostat/galvanostat (e.g. the interface of an EG&G Model 173 potentiostat driving Hewlett-Packard Unity-Gain Voltage Programmable Power Supply) whereby the degree of stripping may be monitored.

The electrochemical stripping bath may contain any suitable acidic solution. Preferably, the acid is either a nitric acid or hydrochloric acid. Any suitable acid concentration up to concentrated solutions may be used. Aqueous acid concentrations containing about 3% to about 15% by volume technical grade acid in water (most preferably nitric or HCl) are preferred because of the greater selectivity achieved with them over more concentrated acid solutions.

The electrochemical operations used to carry out the present process may be carried out for any suitable amount of time and at any temperature to remove the coating from the airfoil without harming the underlying base metal of the airfoil. Preferably, these stripping operations may be carried out at room temperature and for about 15 to about 300 minutes. These conditions are lower and shorter than the conventional soaking processes.

The end point of the stripping process may be predetermined by any standard end-point technique. These include a linear extrapolation of the current/time curve to the time corresponding at zero current; a predetermined ratio of the initial potential or current to the measured potential or current; by predetermined alternating current (AC) or voltage measurements; or by a predetermined absolute quantitative end-point value of current or potential where the process will stop or be reversed.

The present invention is further described in detail by means of the following Examples.

EXAMPLES 1–4

Example 1

Controlled Potential Stripping of Aluminide Coating

Six airfoils (PE4000 $2^{nd}$ stage blades fabricated with PWA 1484 base metal and made by Pratt & Whitney) bearing an aluminide coating (PWA 275 available from Pratt & Whitney)(approximately 0.001" thick) were clamped by their root section into a titanium fixture. These coated airfoils were engine-run for 5,000–11,000 hours. These six airfoils were immersed in the tip-down orientation in a tank containing a solution of 5% by volume concentration hydrochloric acid in water at room temperature. The blades were submerged to their platform level so that the acid solution contacted the areas requiring coating removal but not the root section.

The acid tank also contained an insert comprised of three graphite plates that functioned as counter electrodes. The tank also contains a silver/silver chloride reference electrode, (e.g. Model A6-4-PT available from GMC Corrosion of Ontario, Calif.).

The blades under open circuit conditions were initially at a potential of −350 mV vs. Ag/AgCl. The potential of the blades with respect to the Ag/AgCl reference electrode was adjusted using an external power supply to a controlled value of +200 mV(that has been determined experimentally to provide the greatest selectivity between −350 mV and +500 mV for coating removal). The current flow between the blades and the counter electrode assembly was monitored (by the extrapolated zero-point algorithm based on numeric differentiation of the current/time waveform) to determine the point in time when the aluminide coating would be completely removed. The coating was completely stripped after 45 minutes, and the current flow was discontinued, and the airfoils were removed from the stripping bath.

The completeness of the coating removal was verified non-destructively through heat-tinting one of the six airfoils at 1050° F. in air to produce a characteristic blue color. Additionally, another airfoil was sectioned and examined metallographically to verify the completeness of coating removal and the absence of base metal attack.

Example 2

Controlled Potential Stripping of MCrAlY Coating

Six air foils (PE4000 $1^{st}$ stage blades fabricated with PWA 1480 base metal and made by Pratt & Whitney) bearing a NiCoCrAlY coating (PWA 286 available from Pratt & Whitney) (approximately 0.004" thick) were clamped by their root section into a titanium fixture. These coated airfoils were engine-run for about 5,000 to 11,000 hours. The six airfoils were immersed in the tip-down orientation in a tank containing a solution of 5% by volume concentration hydrochloric acid in water at room temperature. The blades were submerged to their platform level so that the acid solution contacted the areas requiring coating removal, but not the root section.

The tank of solution contained an insert comprised of three graphite plates that functioned as counter electrodes. The tank also contained a silver/silver chloride reference electrode used in Example 1.

The blades under open circuit conditions were initially at a potential of −350 mV vs. Ag/AgCl. The potential of the blades with respect to the Ag/AgCl referenced electrode was adjusted using an external power supply to a controlled value +105 mV (that has been determined experimentally to provide the greatest selectivity between −350 mV and +500 mV for coating removal). The current flow between the blades and the counter electrode assembly was monitored (by the extrapolated zero-point algorithm based on numeric differentiation of the current/time waveform) to determine the point in time when the aluminide coating would be completely removed. When the coating was completely stripped, the current flow was discontinued, and the airfoils were removed from the stripping bath.

The completeness of the coating removal was verified non-destructively through heat-tinting one of the airfoil parts at 1050° F. in air to produce a characteristic blue color. Additionally, another airfoil was sectioned and examined metallographically to verify the completeness of coating removal and the absence of base metal attack.

Example 3

Controlled Current Stripping of Aluminide Coating

One airfoil (PE4000 $2^{nd}$ stage blade fabricated with PWA 1484 base metal and made by Pratt & Whitney) bearing an aluminide coating (PWA 275 available from Pratt & Whitney) (approximately 0.001" thick) was clamped by its root section in a polyvinyl chloride (PVC) fixture and immersed in the tip-down orientation in a beaker of solution of 5% by volume concentration hydrochloric acid in water at room temperature. This coated airfoil was engine-run for about 5,000 to 11,000 hours. The blade was submerged to its platform level so that the solution contacted the areas requiring coating removal, but not the root section.

The beaker of acid solution contained an insert comprised of two graphite plates that functioned as counter electrodes. The tank also contained an Orion Instruments Model 900200 silver/silver chloride reference electrode.

The blade under open circuit conditions was initially at a potential of −350 mV vs. the Ag/AgCl reference electrode. Anodic current was applied to the blade using an external power supply to a controlled value of 50 mA/cm$^2$. The potential of the blade with respect to the reference electrode was monitored to an absolute value greater than +200 mV to determine the point in time when the aluminide coating was completely removed. When the coating was completely stripped (after 45 minutes), the current flow was discontinued, and the blade was removed from the stripping bath.

The completeness of the coating removal was verified non-destructively through heat-tinting of the part at 1050° F. in air to produce a characteristic blue color. Additionally, the airfoil was sectioned and examined metallographically to verify the completeness of coating removal and the absence of base metal attack.

Example 4

Controlled Current Stripping of MCrAlY Coating

One airfoil (PE4000 $1^{st}$ stage blade fabricated with PWA 1480 base metal and made by Pratt & Whitney) bearing a NiCoCrAlY coating (PWA 286) (approximately 0.004" thick) were clamped by its root section to a PVC fixture and immersed in the tip-down orientation in a beaker containing a solution of 5% by volume concentration hydrochloric acid in water at room temperature. This airfoil was engine-run for 5,000 to 11,000 hours. The blade was submerged to a its platform level so that the solution contacted the areas requiring coating removal, but not the root section.

The beaker of acid solution contains an insert comprised of two graphite plates that function as counter electrodes. The tank also contains the same silver/silver chloride reference electrode used in Example 3.

The blade under open circuit conditions was initially at a potential of −350 mV vs. Ag/AgCl. Anodic current was applied to the blade using an external power supply to a controlled value in the range of 50 A/cm$^2$. The potential of the blade with respect of the reference electrode was monitored to an absolute value greater than +200 mV to determine the point in time when the MCrAlY coating is completely removed. When the coating was completely stripped (after 200 minutes), the current flow was discontinued, and the blade was removed from the stripping bath.

The completeness of the coating removal was verified non-destructively through heat-tinting of the part at 1050° F. in air to produce a characteristic blue color. Additionally, the airfoil was sectioned and examined metallographically to verify the completeness of coating removal and the absence of base metal attack.

While the invention has been described above with reference to specific embodiments thereof, it is apparent that many changes, modifications, and variations can be made without departing from the inventive concept disclosed herein. Accordingly, it is intended to embrace all such changes, modifications and variations that fall within the spirit and broad scope of the appended claims.

What is claimed is:

1. A process for electrochemically stripping a coating from an airfoil comprising immersing the airfoil in an electrochemical acid bath for a sufficient period of time to remove the coating from the airfoil while the airfoil in the electrochemical acid bath is maintained with a controlled absolute electrical potential with respect to a reference electrode.

2. The process of claim 1 wherein the controlled absolute electrical potential is a constant absolute electrical potential with respect to a reference electrode.

3. The process of claim 1 wherein the acid is selected from the group consisting of nitric acid and hydrochloric acid.

4. The process of claim 3 wherein the concentration of the acid is from about 3% to about 15% by volume of the acid solution.

5. The process of claim 1 wherein the coating is an aluminide coating.

6. The process of claim 1 wherein the coating is a MCrAlY coating, where M is nickel, cobalt or a mixture thereof.

7. The process of claim 6 wherein the MCrAlY coating is NiCoCrAlY.

8. The process of claim 1 wherein the electrochemical process is stopped at a predetermined end-point.

9. The process of claim 8 wherein the predetermined end-point is determined either by a linear extrapolation of the current/time curve to the time corresponding at zero current; by a predetermined ratio of the initial potential or current to the measured potential or current; by predetermined alternating current (AC) voltage measurements; or by a predetermined absolute quantitative end-point value of current or potential where the process will stop or be reversed.

10. The process of claim 1 wherein the airfoil is made from either a nickel based alloy or a cobalt based alloy.

11. A process for electrochemically stripping at least one aluminide or MCrAlY-coating from an airfoil made of a nickel based alloy or a cobalt based alloy comprising:

immersing the airfoil in an electrochemical acid bath for a sufficient period of time to remove the coating from the airfoil while maintaining on said airfoil a controlled absolute electrical potential with respect to a reference electrode, the acid in the acid bath selected from the group consisting of nitric acid and hydrochloric acid; and stopping the electrochemical process at a predetermined end-point.

* * * * *